United States Patent [19]

Browning

[11] 4,384,434

[45] May 24, 1983

[54] HIGH VELOCITY FLAME JET INTERNAL BURNER FOR BLAST CLEANING AND ABRASIVE CUTTING

[75] Inventor: James A. Browning, Hanover, N.H.

[73] Assignee: Browning Engineering Corporation, Hanover, N.H.

[21] Appl. No.: 306,828

[22] Filed: Sep. 29, 1981

Related U.S. Application Data

[63] Continuation-in-part of Ser. No. 112,492, Jan. 16, 1980, abandoned.

[51] Int. Cl.[3] ..... B24C 7/00

[52] U.S. Cl. ..... 51/410

[58] Field of Search ..... 51/319-321, 51/410, 292, 428, 439; 239/79, 85; 431/158; 175/14

[56] References Cited

U.S. PATENT DOCUMENTS

| | | | |
|---|---|---|---|
| 2,990,653 | 7/1961 | Browning | 51/321 |
| 3,363,661 | 1/1968 | Horton | 431/158 |
| 3,463,249 | 8/1969 | Browning et al. | 51/321 |
| 3,738,792 | 6/1973 | Feng | 431/158 |
| 3,846,066 | 11/1974 | Ebeling | 431/158 |
| 3,854,997 | 12/1974 | Peck et al. | 51/410 |
| 4,130,388 | 12/1978 | Flanagan | 431/116 |
| 4,342,551 | 8/1982 | Browning | 431/158 |

FOREIGN PATENT DOCUMENTS

| | | | |
|---|---|---|---|
| 387115 | 10/1973 | U.S.S.R. | 175/14 |
| 592978 | 2/1978 | U.S.S.R. | 175/14 |
| 676432 | 7/1979 | U.S.S.R. | 51/428 |

*Primary Examiner*—Harold D. Whitehead
*Assistant Examiner*—Robert A. Rose
*Attorney, Agent, or Firm*—Sughrue, Mion, Zinn, Macpeak and Seas

[57] ABSTRACT

In one form, a cylindrical shell extends from an annular burner body to form an elongated combustion chamber, which chamber bears a cylindrical heat radiator element concentric with and spaced radially inward of the shell. A tube coupled to the opposite end of the annular burner body delivers compressed air born abrasive particles to a reduced diameter inlet passage within the burner body. The burner body bears a tubular, slotted sand separator which permits air free of sand to pass along the rear side of the heat radiator for re-entry through radial holes within the heat raditor downstream of the burner body for combustion stabilization. In another form, the combustion chamber is at right angles to the flow passage including the tubular, slotted sand separator and the discharge nozzle. The products of combustion from the combustion chamber at high temperature and velocity, aspirate the abrasive flow through the discharge nozzle.

7 Claims, 2 Drawing Figures

HIGH VELOCITY FLAME JET INTERNAL BURNER FOR BLAST CLEANING AND ABRASIVE CUTTING

This application is a continuation in part application of application Ser. No. 112,492 filed Jan. 16, 1980, now abandoned and identically entitled.

FIELD OF THE INVENTION

This invention relates to internal burners utilizing the combustion of compressed air and fuel to form a high velocity jet and, more particularly, to a burner which has combustion stabilization and which permits the compressed air and abrasive particles to be introduced simultaneously through a single supply line to the combustion chamber.

BACKGROUND OF THE INVENTION

Such high velocity flame jets are useful in the cutting of rock and other solids, the atomization of liquids, and acceleration of particles to high velocity for purposes such as blast cleaning and abrasive cutting of solids. One such burner is the subject of my prior U.S. Pat. No. 2,990,653 issuing July 4, 1961. The burner continuously produces and continuously discharges a blasting stream against a surface. The burner consists in means for moving a combustible fluid through a confined burner space, combusting the fluid in its movement through said space to materially increase the thermal energy and velocity of the resultant stream and means for continuously introducing and suspending in such stream material of a class comprised of hard particulate material, liquids and suspensions of solid particles in liquid media. All of this is achieved without interruption of the travel of the stream and discharging of the stream against a surface to be abraded, cut, etc. The apparatus of the referred to patent requires the feeding of air and abrasives in separate hoses. The use of two hoses is often troublesome due to added complexity where deep hole drilling in rock is effected. Also, two separate hoses may lead to instabilities in the compressed air flow as when the smaller abrasive material flow hose passes through the relatively larger duct of the main air flow hose (to lessen the total hole surface area in deep drilling). Typically, all air flow through the inner hose may halt. The apparatus of U.S. Pat. No. 2,990,653 employs a water cooling jacket to maintain proper cooling of the portions of the burner constituting the combustion chamber.

It is, therefore, a primary object of the present invention to provide an improved high velocity flame jet compressed air and fuel internal burner in which the introduction of abrasive particles to the flame is simplified and in which improved stabilization of the flame reaction is achieved within the combustion chamber.

SUMMARY OF THE INVENTION

The present invention constitutes an improvement in a compressed air and fuel internal burner producing a high velocity abrasive particle flame jet for cutting rock and other solids in which the burner includes means defining a combustion chamber space. Means are provided for continuously feeding to said space a stream of combustible fluid bearing hard particulate material and means for effecting combustion of the fluid within said space. The improvement comprises means for separating combustible fluid free from said particulate material upstream of said space and for introducing the particle free combustible fluid into the space, downstream of its inlet end thereof to stabilize flame reaction within the combustion chamber.

In one form, the burner is cylindrical in form and comprises an annular burner body abuttingly joined, at its downstream end, to a tubular shell which forms an elongated combustion chamber. Concentrically mounted within the shell and constituting an extension of the burner body is a tubular refractory metal heat radiator which through the major portion of its extent is spaced radially from the shell, and wherein the means for separating the combustible fluid free of the particulate material is fluid connected to the annular chamber between the metal heat radiator and the shell for cooling the outer surface of the shell and for introduction of particle free combustible fluid into the upper end of the elongated combustion chamber to define a combustion stabilization region adjacent the interface between the shell combustion chamber and the burner body. The heat radiator may be of copper, steel or other metal in lieu of a refractory metal.

The annular burner body bears a cylindrical sand separator axially within its upper end, the sand separator including a plurality of longitudinally spaced radial slots having a width less than the diameter of the particles carried by the combustible fluid. An annular chamber exists between the sand separator and the burner body which annular chamber is fluid connected to the annular chamber surrounding the metal heat radiator to permit free passage of combustible fluid absent the hard particulate material for cooling of the rear surface of the heat radiator and for permitting the introduction of the combustible fluid into the combustion chamber at the downstream end of the refractory metal heat radiator. A reduced diameter inlet nozzle is borne by the burner body axially downstream of the sand separator to effect high velocity introduction of the particulate material bearing combustible fluid stream into the upper end of the elongated combustion chamber at the upstream end of the refractory metal heat radiator element. The sand separator may be eliminated from the assembly.

In a second form, the cylindrical shell is connected at one end to the annular burner body at right angles to the axial flow passage through the annular burner body. An opening within the annular body communicates the elongated combustion chamber with the annular burner body axial flow passage. Further, the annular body includes axial spaced inlet and outlet nozzles and an enlarged cylindrical chamber intermediate of said nozzles with the nozzles and the cylindrical chamber forming a part of the axial flow passage, downstream of the cylindrical sand separator. The cylindrical chamber is open to the combustion chamber by way of the radial opening within the annular burner body such that the volume of the cylindrical chamber permits the products of combustion to expand to atmospheric pressure through the radial opening of the cylindrical chamber and the outlet nozzle to substantially increase in velocity and to function to accelerate the flow of abrasive material separated from a major portion of the air stream within the sand separator to provide at the outlet of the discharge nozzle, a combined flame jet and abrasive flow materially enhancing the cutting and abrading capability of the compressed air and fuel internal burner.

DESCRIPTION OF THE PREFERRED EMBODIMENT

Figure 1:
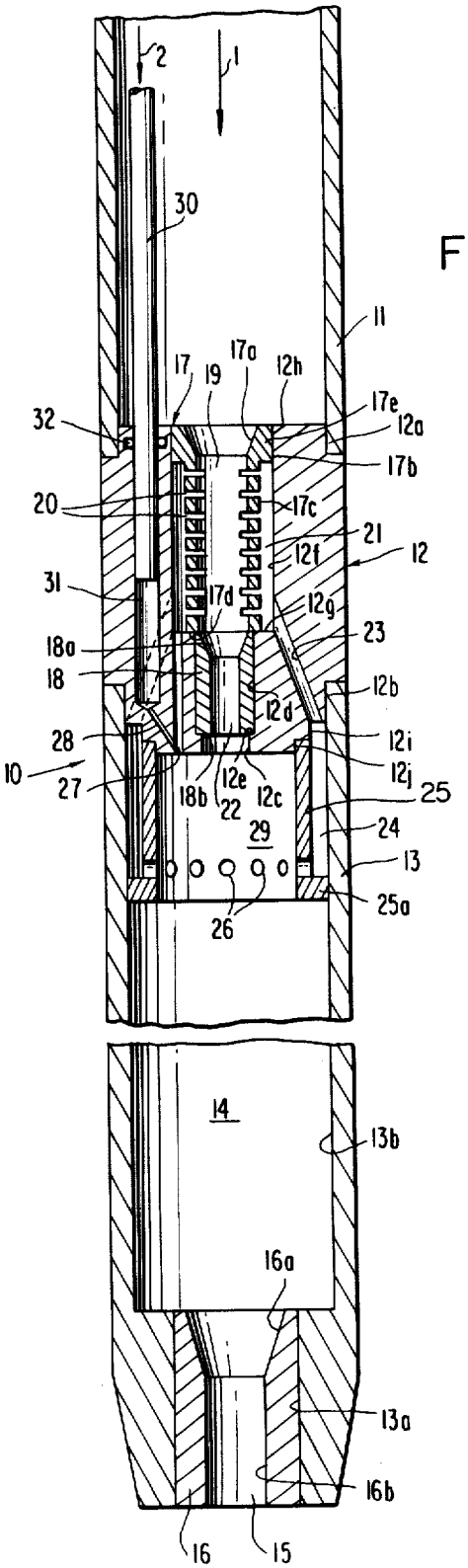
FIG. 1 is a vertical sectional view of the improved high velocity flame jet blast cleaning and abrasive cutting compressed air and fuel internal burner of the present invention as applied to a bore hole cutting rig and forming one embodiment of the present invention.

The present invention, in one form, is directed to an improved internal burner indicated generally at 10, forming an integral component of a bore or well drilling assembly and constituting an extension as an integral component of a hollow tube 11 formed of metal. Tube 11 supplies to the burner 10 compressed air (in this case with entrained abrasive solid particles), as indicated schematically by arrow 1, which flow constitutes a high velocity stream passing downwardly through the tube 11 to the upper wall **12*h* of an annular metal burner body 12. The annular burner body 12 is provided with an annular peripheral recess 12*a* at its upper end which receives the lower end of tube 11 and which may be threadably coupled thereto, for instance. The lower end of the burner body 12 is provided with a second peripheral recess as at 12*b* to which a tubular metal shell 13 is rigidly coupled as by being threaded to the burner body 12, for instance. The shell 13 is provided with a bore at 13*a* and a counterbore 13*b*, the counterbore 13*b* forming an elongated combustion chamber as at 14 which extends the major axial length of the shell 13. The bore 13*a* bears a tungsten carbide nozzle 16 in the form of a cylindrical metal body having a reduced diameter outlet passage as at 15, defined by a bore 16*b*, which bore opens outwardly at its upper end in an inclined or tapered fashion as at 16*a*, forming a tapered throat leading to the reduced diameter outlet passage 15**.

With respect to the burner body 12, it is provided with a bore **12*c*, a counterbore 12*d* forming a shoulder 12*e* and a further counterbore at 12*f* forming a second shoulder 12*g*. Counterbore 12*f* receives in a slidable fit, a cylindrical or tubular metal sand separator indicated generally at 17, which bears a relatively small diameter axial passage 19 which opens outwardly by way of an enlarged, tapered inlet 17*a* at its upper end. The outer periphery 17*b* of the sand separator 17 is recessed at 17*c* over a majority of its length from its lower end 17*d* towards the upper end and terminates at radial flange 17*e* bearing tapered inlet 17*a* so as to define with the counterbore 12*f*, an annular separated air collection chamber 21. Throughout the axial passage 19, there are provided, within said separator, a plurality of laterally opposed, arcuate, radial slots 20 which are of a thickness less than the diameter of the abrasive particles borne by the compressed air and hard particle material stream 1 which enters the axial passage 19 from tube 11 at the upper end of the burner body 12. Bore 12*c* of the burner body is considerably smaller in diameter than either counterbore 12*d* or 12*f*. Within counterbore 12*d* is provided a tungsten carbide inlet nozzle 18 of cylindrical form and having an outside diameter on the order of the diameter of bore 12*d*, so as to snugly fit within bore 12*d* with its lower end abutting shoulder 12*e*. The tungsten carbide inlet nozzle 18 is provided with an axial inlet passage 22 which opens outwardly at its upper end by way of a tapered inlet passage portion 18*a*. Thus, the air and particle flow is being constantly constricted, that is, reduced in diameter and having its velocity increased as the flow stream moves from arrow 1 to the lower exit end 18*b* of inlet nozzle 18**.

In addition to recess **12*d* at the lower end of the burner body 12, there is provided further stepped peripheral recesses as at 12*c*, 12*j*, of increasingly reduced diameter, the recess 12*j* receiving the upper end of a cylindrical refractory metal heat radiator element 25. Element 25 has an outer diameter on the order of the peripheral recess 12*c* and an inner diameter on the order of peripheral recess 12*j*. Further, the refractory metal heat radiator element 25 terminates at its lower end in radial flange 25*a* whose outer diameter is on the order of counterbore 13*b* of shell 13 and to which is is sealably affixed. The refractory metal heat radiator element therefore forms an annular chamber 24 which is extended axially by the peripheral recess 12*i*. A plurality of circumferentially spaced, inclined air passages 23 within the burner body 12 communicate annular chamber 21 to chamber 24 such that air separated from the abrasive particles flows along the rear of the refractory metal heat radiator element tending to cool the same in the area of combustion which is initiated internally of the refractory metal heat radiator element at the downstream end of the burner body 12. This particle free air escapes to the interior of the refractory metal heat radiator element by way of a plurality of circumferentially spaced, small diameter radial ports 26 directly into a combustion stabilization region 29 of the burner at the upstream end of the elongated combustion chamber 14. The element 25** which is formed of refractory metal reaches red hot temperatures due to the flame which is maintained adjacent to its inner periphery.

The air passing through annular chamber 24 becomes heated to a sufficiently high temperature to provide the necessary vaporization of the liquid fuel jet which exits from a fuel nozzle 28, constituted by a small diameter passage which is inclined relative to the axis of the burner and which opens at its lower end directly into a longitudinally extending air passage 27. Passage 27 extends from and is aligned with the annular separated air collection chamber 21. Air passing therethrough aspirates fuel from fuel nozzle 28 into the combustion stabilization region 29 of the burner where it mixes with air from inlet nozzle 18 and air from ports 26.

The fuel itself is delivered to the burner through a fuel supply tube 30 passing internally within tube 11, tube 30 projecting into a longitudinal fuel delivery passage 31 having a diameter on the order of the external diameter of the fuel supply tube 30. An O-ring seal 32 surrounds the tube 30 where it projects into the burner body 12 to seal passage 31 and prevent leakage of the fuel into the air flow prior to their mixing in the combustion stabilization region 29 after being aspirated into that region by air passing downwardly through air passage 27. Fuel is indicated as passing through tube 30 schematically by way of arrow 2. In addition to conductive heating of the fuel particles by the hot air passing through the ports 26, the fuel also receives radiant energy from hot wall of the element 25. Further, the heated air itself results in combustion stabilization with the major portion of the flame borne by the elongated combustion chamber 14.

The principles of the improved burner of the present invention, when compared to current internal burner practice, yields three important advances. First, as mentioned previously, it eliminates the necessity of providing dual hoses for supplying both air and abrasive particles. Secondly, it eliminated problems of instability of compressed air flow. Thirdly, the heat radiator element of refractory metal as at 25 allows the use of a small diameter combustion chamber which may be fully water cooled by jacketing the burner body 12 and shell 13 in a manner similar to that of my prior U.S. Pat. No. 2,990,653. The refractory metal heat radiator element 25 is formed of a length which will add an adequate amount of heat to the air and fuel at the point of mixture and initiation of combustion within the combustion stabilization region 29 of the improved burner 10. If the refractory metal heat radiator element 25 is too long, it is heated to such a degree that it will melt. It may comprise copper or steel rather than a refractory metal.

A typical burner employing the principles of the present invention would be one where the outside diameter of shell 13 and tube 11 is approximately 2½ inches, the slot thickness or width for the radial slots 20 is approximately 0.030 inches. The inlet nozzle 18 has a passage diameter of 5/16 of an inch. The length of the refractory metal heat radiator element from the end of the burner body 12 to the ports 26 is one inch. The inner diameter of that element is 1⅜ inches. The combustion chamber diameter is 1⅝ inches. The combustion chamber length is 12 inches and the exit nozzle diameter and the outlet passage for the tungsten carbide nozzle 16 is ⅝ inch in diameter.

As may be further appreciated, the high velocity flame jet internal burner of the present invention is highly useful where the air flow passing through the annular burner body does not bear abrasive or other hard particulate material. In this case, the sand separator, element 17, may be physically removed and left out of the burner. However, the action of separating a portion of the air flow whose velocity is reduced by passage through passages 23 and annular chamber 24, still functions when emitted at 26 into the top of the burner combustion chamber 14 to favorably stabilize the combustion process, and wherein the heat radiator 25 whether formed of a refractory metal or other good conductor such as steel or copper, becomes highly heated and functions to improve the combustion of the fuel and air mixture. Some air passes through passage 27, causing aspiration of the fuel and mixing of the same with the air as it enters the combustion chamber stabilization region or zone 29. Under those conditions, no abrasive is necessary since flame jet cutting of very good stone can be achieved without the necessity of abrasive particulate material being borne by the high velocity air passing through the burner structure.

Figure 2:
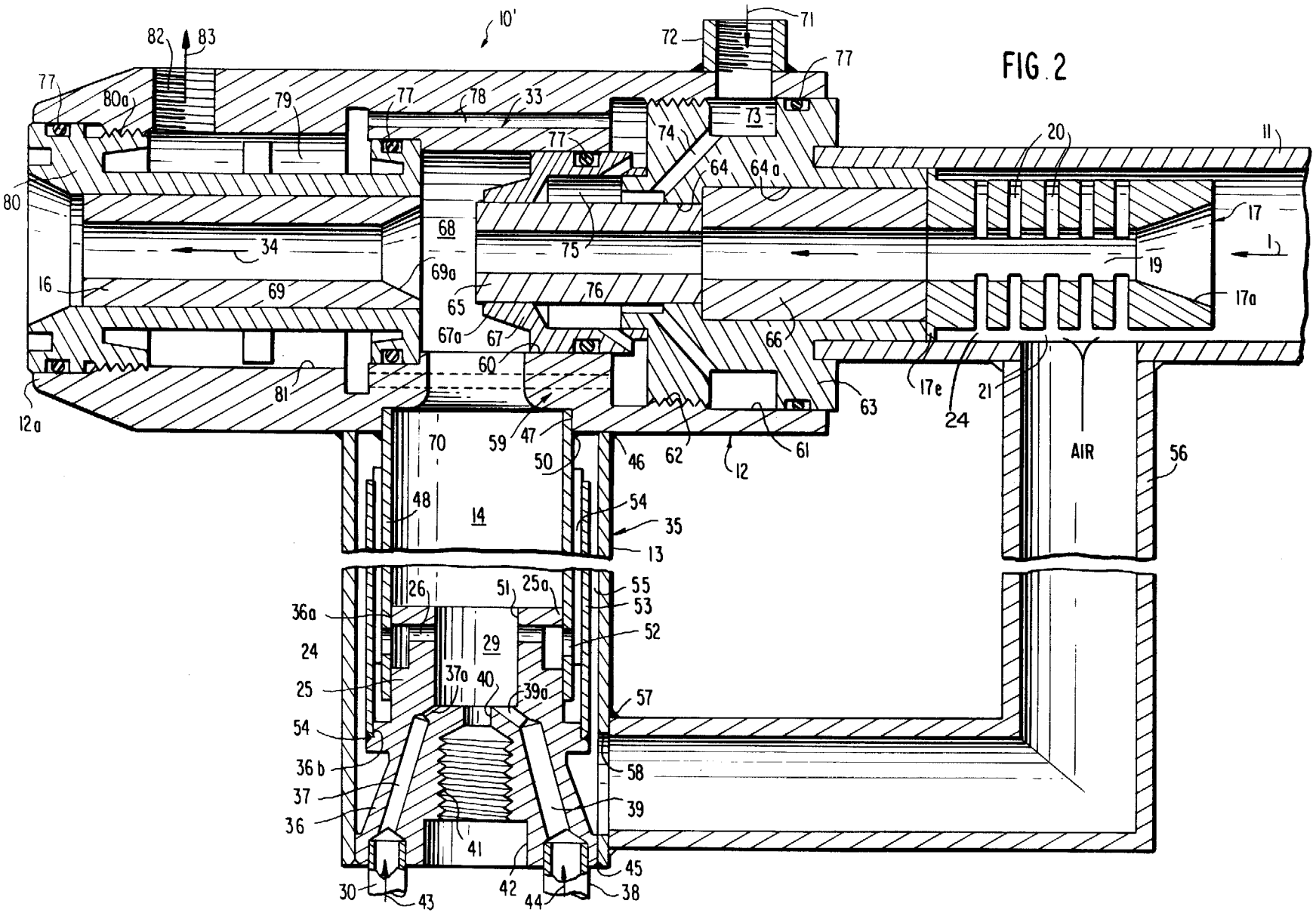
FIG. 2 is a vertical sectional view of a second embodiment of the invention wherein the combustion chamber is at right angles to the flow path of the particulate abrasive material.

Turning next to FIG. 2, there is shown a second embodiment of the present invention, taking the form of a high velocity flame jet internal burner 10' employed for blast cleaning and abrasive cutting, the burner being of generally T form in vertical configuration, providing a horizontal flame jet bearing particulate material for high velocity, high temperature abrasion of a work piece downstream and to the left of the discharge nozzle end of the embodiment. Like elements in this embodiment bear like numerals to that of the embodiment of FIG. 1. In that regard, a hollow tube 11 functions to supply compressed air and abrasive in the form of particulate material bearing stream to the apparatus as indicated by arrow 1, the tube 11 being integrated to and coupled to one end of an annular body 12. The compressed air bears entrained solid particles forming a relatively high velocity stream. At the termination of the hollow metal tube 11, the stream of air and entrained abrasive material enters a slidable fit, cylindrical or tubular metal sand separator indicated generally at 17 bearing a relatively small diameter axial passage 19 which opens upstream by way of an enlarged tapered inlet as at **17*a*. The sand separator terminates at its opposite end in a radially outwardly directed flange 17*e*. The sand separator functions with the hollow tube 11 to define an annular space 21 functioning as an air collection chamber. A plurality of laterally opposed arcuate radial slots 20, which are of a thickness less than the diameter of the abrasive particles borne by the compressed air and hard particle material stream 1 entering the axial passage 19, are provided within the separator 17 so as to communicate bore 19 with collection chamber 21. Thus, in the manner of the prior embodiment, some air is permitted to separate from the abrasive material, collecting within annular chamber 21**.

In this embodiment, the apparatus is generally T shaped in configuration with an elongated cylindrical metal shell 13 welded to the side of burner body 12 and projecting at right angles therefrom, with the elongated shell 13 encompassing an elongated combustion chamber 14. Unlike the prior embodiment, the abrasive material does not flow through the combustion chamber. Instead, the products of combustion exiting from the combustion chamber 14 at a high speed function to entrain the abrasive material and by aspiration effect discharge it at high velocity as a combined flame jet and abrasive through a discharge nozzle.

In some respects, the phenomena and operation is similar to that occurring in my copending patent application Ser. No. 152,966 filed May 23, 1980, and entitled "Method and Apparatus for Ultra High Velocity Dual Stream Metal Flame Spraying". Reference may be had to that application for a more complete understanding of the entrainment and aspiration effect also utilized in the embodiment of FIG. 2, although it is believed that a full and complete description is provided herein. In that respect, therefore, the burner body 12 houses elements forming an accelerator indicated generally at 33 which speeds up the velocity of the abrasive material particles separated from the air and abrasive stream 1 to ultra-high or extreme velocity, with the particles being projected as a combined flame jet and abrasive stream as indicated by arrow 34 from within a discharge nozzle 16 at the discharge side of accelerator 33. Thus, shell 13 and the components within the same define a lower burner portion or internal burner indicated generally at 35. The internal burner 35 is supplied with fuel by way of a fuel line 30 which connects to a cylindrical burner head 36 and opens to a fuel passage 37 terminating in a small diameter fuel passage portion **37*a* opening directly to a reduced diameter portion of the combustion chamber 14 forming a combustion stabilization region 29 at the upstream end of said combustion chamber. An oxygen tube 38 connects to burner head 36 and communicates with an oxygen supply passage 39 terminating in a reduced diameter portion 39*a* leading directly to the combustion chamber flame stabilization portion 29. Head 36 is axially bored as at 40, is further counterbored, tapped and threaded at 41, and additionally counterbored at 42, permitting a spark plug (not shown) to be threaded thereto to permit ignition of a fuel oxygen mixture entering the combustion chamber 14**, as supplied by a fuel supply indicated schematically by arrow 43 and an oxygen supply indicated schematically by arrow 44, through tubes 30 and 38, respectively.

The head 36 is directly welded to the end of tube 13 as at 45; the opposite end of the tube 13 being welded at 46 to the sidewall of the cylindrical body 12. The cylindrical body 12 includes a circular hole 47 which receives a smaller diameter cylindrical tube preferably formed of a ceramic material as at 48 which is also welded to the body as at 50. The opposite end of the cylindrical tube 48 receives a projecting portion 36*a* of head 36 to which it is welded or otherwise affixed. Body 12, inner tube 48, and head 36 thus define the combustion chamber 14. Head portion 36*a* is provided with a counterbore 51 defining the combustion stabilization region 29 for the burner, at the upstream end of the combustion chamber 14, as in the prior embodiment. The head 36 is preferably formed of a refractory metal, or at least portion 36*a*, such that portion 36*a* defines a cylindrical refractory metal heat radiator element. The element has an outer diameter on the order of the inner diameter of cylinder 48 and bears an annular recess as at 24 over a substantial length of the head portion 36*a*. The annular recess or chamber 24 opens to the stabilization chamber 29 by way of a plurality of circumferentially spaced, small diameter, radial ports 26. Further, the cylinder 48 is provided with at least one radial opening or hole 52 which communicates with an annular passage defined by an intermediate diameter sheet metal sleeve 53, one end of which is welded as at 54 to the head 36, via a notched portion 36*b* within the side of the head.

The opposite end of the sleeve 53 terminates short of body 12 so that the annular space 54 between cylinder 48 and sleeve 13 communicates to a further annular space 55, between the outer shell 13 and sleeve 53.

Additionally, a hose or pipe 56 emanates from tube 11 and is connected at its opposite end to the end of shell 13 remote from body 12, being concentric with a hole 58 and sealed to the outer surface of that member as by being welded thereto at 57. It opens directly to circular hole 58 within the shell 13 so as to communicate and direct the separated air from chamber 21 associated with the sand separator 17 to the combustion stabilization region 29. The air passes through a tortuous passage defined by annular spaces 54, 55 and annular chamber 24 prior to reaching the flame stabilization chamber 29. The air passing through annular chamber 24 becomes heated to a sufficiently high temperature to provide the necessary vaporization of the liquid fuel jet which exits from the fuel supply tube and its reduced diameter passage portion 37*a* defining a fuel nozzle and opening to the combustion chamber. Initially, for ignition purposes only, pure oxygen is fed through oxygen supply tube 38 to mix with the fuel with spark ignition effected at the area of mixture at the upstream end of the stabilization chamber 29 bearing the spark plug. The labyrinth passages 54, 55 permit the air to cool, particularly the outer shell 13, prior to entering the combustion chamber. Thus, air separated from the abrasive particles in flowing along the rear of the refractory metal heat radiator element tends to cool the same in the area of initial combustion.

In this embodiment, a portion of the body 12 defines an injector element manifold nozzle indicated generally at 59 in which certain elements are integrally machined into the body 12 while others form components threaded thereto or otherwise mounted within the annular or cylindrical body 12. In this respect, the body 12 is provided with a bore as at 60, and at the upstream end (in terms of the direction of flow of abrasive) is counterbored as at 61 with a portion threaded as at 62 so as to receive a threaded annular head 63. The head 63 in turn is bored at 64 and counterbored at 65. The bore 64 of head 63 bears a tubular abrasive supply tube 65, while the counterbore 65 bears a cooperating tubular insert 66 whose function is to feed the abrasive material separated from the major portion of the air stream of flow 1 for supply to the accelerator element 33. Bore 60 carries an annular insert 67 which in turn coaxially supports, internally, the inlet nozzle 65. Tubular element 65 abuts the member 66 at one end and is spaced rearwardly from the outlet nozzle 16 to define with the outlet nozzle 16 and the annular insert 67 a cylindrical chamber 68 leading to a bore 69 within the outlet nozzle 16 by way of a conical entry portion or throat 69*a*.

Further, the cylindrical chamber 68 is open directly at its bottom through a reduced diameter passage 70 to the interior of the combustion chamber at the end remote from the spark plug. As may be appreciated, the opening 70 within the sidewall of the body 12 functions as a discharge nozzle for the combustion chamber so that the flame jet entering chamber 68 and directed towards the throat 69*a* of the outlet nozzle 16 is partially deflected by impact with an inclined annular wall 67*a* of the annular insert 67. In similar fashion to tube 65, the discharge nozzle 16 may be formed of a refractory metal.

As may be appreciated, it is important to cool the body 12 and the elements carried internally thereof through which the very high temperature burner exhaust gases and abrasive material traverse. In this respect, a liquid such as water is employed as a coolant and enters the interior of body 12 as indicated by arrow 71 through an inlet fitting 72 which opens to an annular chamber 73 within the head 63. The flow is transmitted through a plurality of inclined passages 74 to an annular chamber 75 immediately surrounding the annular insert 67 and formed by a counterbore 76 within that member. Further, certain of the members bear annular seals within grooves, the seals being indicated at 77 and taking the form of O-rings. This prevents water entry into the combustion area or flame jet path. The body 12 carries elongated passages as at 78 by which the coolant travels over a portion of the length of the body 12 and enters a further annular chamber as at 79 defined by an outlet nozzle support member 80 and a further counterbore 81 within body 12. The cylindrical support body 80 is threaded as at 80*a* to a portion of the counterbore 81. Further, the body 12 is provided with an outlet passage 82, whereby the coolant is exhausted and returned to inlet fitting 72 in a typical coolant loop by means (not shown) as indicated at arrow 83.

As may be appreciated, during operation, the flame jet or the products of combustion from combustion chamber 14 pass through combustion chamber outlet nozzle or exit passage 70, completely around (through 360°) cylindrical cavity or chamber 68. The hot gases expand to ambient atmospheric pressure through nozzle bore 69 acting to accelerate the flow of abrasives separated from the air and abrasive stream 1. Further, structural and functional aspects of the copending application Ser. No. 152,966 may be employed in the T form of blast cleaning apparatus of this invention. In operation, the sand separator 17 functions to initially permit a single hose coupling to the apparatus and a single flow stream as at 1, of both air and abrasive parriculate material. Unlike the first embodiment, the abrasive material does not pass through the combustion chamber, the combustion chamber being to one side, and the products of combustion function to accelerate the flow of abrasive material and create a combined flame jet and abrasive flow discharging from the outlet nozzle 16 in the manner of arrow 34.

The principles of operation of the second embodiment are identical to those of the first embodiment.

While the invention has been particularly shown and described with reference to a preferred embodiment thereof, it will be understood by those skilled in the art that various changes in form and details may be made therein without departing from the spirit and scope of the invention.

What is claimed is:

1. In a compressed air and fuel internal burner for producing a high velocity flame jet for cutting rock and other solids, said flame jet including hard particulate material forming an abrasive, said burner including:

means defining a confined burner space, means for continuously feeding through said space a stream of combustible fluid, means for effecting combustion of the combustible fluid within said space and for discharging the combustion provided therefrom, and means for supplying hard particulate material to the combustion products discharging from the confined burner space and for forming a high velocity flame jet bearing said hard particulate material forming said abrasive, the improvement wherein said hard particulate material supplying means comprises means for supplying a stream of combustible fluid bearing hard particulate material to said burner upstream of said confined burner space and includes means defining a confined straight flow path through said burner for said combustible fluid bearing said hard particulate material and terminating in an axial flow jet nozzle forming said high velocity fluid jet, and wherein said burner further comprises means within said confined straight flow path for separating a portion of said combustible fluid radially outward of said confined straight flow path from said hard particulate material and for introducing said particle free fluid into a combustion stabilization region in the vicinity of the upstream end of said confined burner space for stabilization of the flame reaction within said confined burner space.

2. The compressed air and fuel internal burner as claimed in claim 1, wherein said burner comprises:

an annular burner body having an axial flow passage therethrough, forming part of said straight flow path defining means, a cylindrical shell connected at one end to said annular burner body defining an elongated combustion chamber and forming said confined burner space, said combustion chamber having a diameter in excess of the axial flow passage within said burner body, a cylindrical metal heat radiator element concentrically positioned within said combustion chamber and being fixed to the end of said burner body and extending axially therefrom and being spaced from said shell to form a chamber therebetween, and wherein said means for separating combustible fluid free of said particulate material comprises a cylindrical sand separator positioned within said burner body axial flow passage and bearing longitudinally spaced radial slots having a width less than the diameter of the particulate material of said stream, and means for collecting fluid separated from said particulate material passing through said slots of said sand separator and for directing said separated fluid to said chamber intermediate of said metal heat radiator element and said shell, and radial ports within said metal heat radiator element to permit the re-introduction of particle free air into the combustion stabilization region defined by said metal heat radiator element downstream of said burner body axial flow passage.

3. The compressed air and fuel internal burner as claimed in claim 2, wherein said annular burner body comprises a bore and a pair of counterbores from the end proximate to said elongated combustion chamber towards the opposite end thereof, and said burner further comprises a cylindrical tungsten carbide inlet nozzle having a diameter on the order of said first counterbore and being positioned within said counterbore and extending the length thereof, said sand separator comprises a cylindrical element having an outer diameter on the order of that of said second counterbore and being positioned therein and extending the length thereof, said sand separator being recessed on its outer periphery over a major portion of its length and bearing said radial slots along said recessed portion and defining with said burner body a separated air collection chamber, and wherein said cylindrical metal heat radiator element includes an outer peripheral recessed portion defining said chamber between said element and said shell, and wherein at least one passage within said burner body fluid connects said separated air collection chamber and said chamber adjacent said metal heat radiator element such that particle free air passes from said separated air collection chamber to said annular chamber radially exterior of said metal heat radiator element and enters said combustion chamber through said radial ports with said radiator element downstream from the end of said burner body and from said inlet nozzle.

4. The compressed air and fuel inlet burner as claimed in claim 2, wherein said burner further comprises an elongated cylindrical longitudinal fuel delivery passage extending longitudinally from the end of said burner body bearing said sand separator parallel to said annular burner body axial flow path, a fuel supply tube coupled to said burner body and partially projecting within said longitudinal fuel delivery passage and being sealably coupled thereto, and an air passage extending longitudinally through said burner body from said second counterbore to the end of said burner body proximate to said elongated combustion chamber and opening to said elongated combustion chamber within said combustion stabilization region, and a fuel nozzle extending from said fuel passage to said air passage and opening into said air passage approximately at the point where the air passage opens to the combustion chamber; whereby, fuel supplied to said fuel delivery passage by said fuel supply tube is aspirated into said combustion stabilization region of said elongated combustion chamber by separated air passing through said longitudinal air passage, where the fuel further mixes with the stream of combustible fluid bearing hard particulate material entering the confined burner space from said axial flow passage of said burner body and particle free combustible fluid introduced into said combustion stabilization region through said radial ports of said metal heat radiator element.

5. The compressed air and fuel inlet burner as claimed in claim 3, wherein said burner further comprises an elongated cylindrical longitudinal fuel delivery passage extending longitudinally from the end of said burner body bearing said sand separator parallel to said annular burner body axial flow path, a fuel supply tube coupled to said burner body and partially projecting within said longitudinal fuel delivery passage and being sealably coupled thereto, and an air passage extending longitudinally through said burner body from said second counterbore to the end of said burner body proximate to said elongated combustion chamber and opening to said elongated combustion chamber within said combustion stabilization region, and a fuel nozzle extending from said fuel passage to said air passage and opening into said air passage approximately at the point where the air passage opens to the combustion chamber; whereby, fuel supplied to said fuel delivery passage by said fuel supply tube is aspirated into said combustion stabilization region of said elongated combustion chamber by separated air passing through said longitudinal air passage, where the fuel further mixes with the stream of combustible fluid bearing hard particulate material entering the confined burner space from said axial flow passage of said burner body and particle free combustible fluid introduced into said combustion stabilization region through said radial ports of said metal heat radiator element.

6. The compressed air fuel internal burner as claimed in claim 1, wherein said means for separating combustible fluid free of said hard particulate material from said stream comprises a cylindrical sand separator positioned within said burner body axial flow passage, said cylindrical sand separator bearing longitudinally spaced radial slots having a width less than the diameter of said hard particulate material from said stream and wherein said combustion chamber comprises a cylindrical metal heat radiator element concentrically positioned within said combustion chamber and extending axially therefrom and being spaced from said shell to form a chamber therebetween, and means for fluid coupling said slots of said sand separator to said chamber intermediate of said metal heat radiator element and said shell, and radial ports within said metal heat radiator element to permit the re-introduction of particle free air into the combustion stabilization region defined by said metal heat radiator element.

7. The compressed air fuel internal burner as claimed in claim 6, wherein said cylindrical shell is connected at one end to said annular burner body at right angles to the axial flow passage through said annular burner body, a radial opening within said annular burner body communicating said elongated combustion chamber with said annular burner body axial flow passage, said annular burner body including axially spaced inlet and outlet nozzles and an enlarged cylindrical chamber intermediate of said nozzles with said nozzles and said cylindrical chamber forming a part of said axial flow passage and downstream of said cylindrical sand separator, said cylindrical chamber being open to said combustion chamber by way of said radial opening within said annular burner body, and wherein the volume of the cylindrical chamber is such that the products of combustion from the combustion chamber in expanding to atmospheric pressure through said radial opening, said cylindrical chamber and said outlet nozzle substantially increases in velocity and functions to accelerate the flow of abrasive material separated from a major portion of the combustible fluid stream within said sand separator to provide at the outlet of said discharge nozzle a combined flame jet and abrasive flow, materially enhancing the cutting and abrading capability of said compressed air and fuel internal burner.

* * * * *